US007669921B2

(12) United States Patent
Hoffman et al.

(10) Patent No.: US 7,669,921 B2
(45) Date of Patent: Mar. 2, 2010

(54) RECLINING SEATING UNIT WITH HEADREST

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 11/856,901

(22) Filed: Sep. 18, 2007

(65) Prior Publication Data

US 2009/0072593 A1 Mar. 19, 2009

(51) Int. Cl.
*A47C 1/02* (2006.01)

(52) U.S. Cl. ..... 297/61; 297/84; 297/391

(58) Field of Classification Search ..... 297/61, 297/75, 84, 85, 86, 391, 410
See application file for complete search history.

(56) References Cited

U.S. PATENT DOCUMENTS

| | | | | | |
|---|---|---|---|---|---|
| 2,843,183 | A | * | 7/1958 | Luckhardt | 297/61 |
| 2,843,184 | A | * | 7/1958 | Lorenz | 297/61 |
| 2,869,619 | A | * | 1/1959 | Petersen et al. | 297/61 |
| 2,984,293 | A | | 5/1961 | Bontempi et al. | |
| 2,996,332 | A | * | 8/1961 | Kurtyka et al. | 297/61 |
| 3,021,098 | A | * | 2/1962 | Spound | 297/61 |
| 3,057,657 | A | * | 10/1962 | Fletcher | 297/61 |
| 3,074,758 | A | | 1/1963 | Schliephacke | |
| RE25,375 | E | * | 4/1963 | Lorenz | 297/61 |
| 3,102,753 | A | * | 9/1963 | Schliephacke | 297/61 |
| 3,140,117 | A | * | 7/1964 | Fletcher | 297/61 |
| 3,652,125 | A | | 3/1972 | Rogers, Jr. | |
| 3,836,197 | A | * | 9/1974 | Goff et al. | 297/391 |

(Continued)

FOREIGN PATENT DOCUMENTS

DE 26 01 691 A1 7/1977

OTHER PUBLICATIONS

The International Search Report and Written Opinion for PCT/US2008/010721, dated Sep. 15, 2008.

*Primary Examiner*—David Dunn
*Assistant Examiner*—Patrick Lynch
(74) *Attorney, Agent, or Firm*—Myers Bigel Sibley & Sajovec

(57) ABSTRACT

A reclining seating unit includes: a base configured to rest on an underlying surface; a seat; a backrest that includes a body and a headrest that is positioned above the body; a reclining mechanism that interconnects the base, seat and backrest that controls the movement thereof between an upright position, in which the seat is generally horizontally disposed above the base and the backrest is generally vertically disposed at a first angle to the underlying surface above a rear portion of the backrest, and a fully reclined position, in which the backrest is disposed at a second angle to the underlying surface, the second angle being less than the first angle; and a headrest mechanism coupled to the reclining mechanism and attached to the body and headrest. In the upright position, a lower edge of the headrest is positioned at a first distance from an upper edge of the body, and in the reclined position, the lower edge of the headrest is positioned a second distance from the upper edge of the body, the second distance being greater than the first distance. The headrest moves generally parallel to the backrest as the chair moves from the upright to the reclined position.

14 Claims, 8 Drawing Sheets

U.S. PATENT DOCUMENTS 3,844,607 A 10/1974 Ré
3,871,704 A * 3/1975 Shoemaker et al. ..... 297/61
3,942,835 A 3/1976 Harrison
4,188,062 A 2/1980 Rogers, Jr. et al.
4,691,961 A 9/1987 Rogers, Jr. et al.
4,830,429 A 5/1989 Petitjean
5,044,692 A 9/1991 Tidwell, Jr. et al.
5,310,243 A 5/1994 Pine
5,346,277 A * 9/1994 Holobaugh et al. ..... 297/61
5,374,100 A * 12/1994 Rogers et al. ..... 297/61
6,192,565 B1 * 2/2001 Tame ..... 297/61

* cited by examiner

RECLINING SEATING UNIT WITH HEADREST

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest or ottoman that provides support for the occupant's feet in the reclined position.

One particularly popular recliner is the "three-way" recliner, which has two reclined positions: an intermediate "TV position", in which the footrest or ottoman of the chair is projected forwardly from the chair while the backrest remains substantially upright relative to the seat; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position, and from a "one-way" recliner, which typically has no intermediate "TV" position.

One recliner chair feature that has become popular in some models is a headrest that is retracted when the recliner chair is in its upright position and extends when the reclining chair moves to a reclined position. Such a headrest can provide support for the occupants head, which may increase comfort for a reclining occupant, particularly in chairs in which styling demands a relatively low backrest. An exemplary headrest is described and illustrated in U.S. Pat. No. 5,346,277 to Holobaugh et al. The chair illustrated therein includes a headrest that is generally horizontally disposed atop the backrest when the chair is in the upright position and generally vertically disposed above the backrest when the chair is in a reclined position. A headrest that folds within a cavity in the rear surface of the backrest, then inverts as it extends, is illustrated in U.S. Pat. No. 3,652,125 to Rogers. The disclosures of each of these patents are hereby incorporated herein by reference.

As chair styling continues to evolve, it may be desirable to provide additional headrest configurations, particularly for certain types of chairs for which styling concerns dictate the size and shape of the backrest.

SUMMARY OF THE INVENTION

As a first aspect, embodiments of the present invention are directed to a reclining seating unit, comprising: a base configured to rest on an underlying surface; a seat; a backrest that includes a body and a headrest that is positioned above the body; a reclining mechanism that interconnects the base, seat and backrest that controls the movement thereof between an upright position, in which the seat is generally horizontally disposed above the base and the backrest is generally vertically disposed at a first angle to the underlying surface above a rear portion of the backrest, and a fully reclined position, in which the backrest is disposed at a second angle to the underlying surface, the second angle being less than the first angle; and a headrest mechanism coupled to the reclining mechanism and attached to the body and headrest. In the upright position, a lower edge of the headrest is positioned at a first distance from an upper edge of the body, and in the reclined position, the lower edge of the headrest is positioned a second distance from the upper edge of the body, the second distance being greater than the first distance. The headrest moves generally parallel to the backrest as the chair moves from the upright to the reclined position. This configuration can provide different styling options for the chair, and can enable the use of a relatively tall headrest with a relatively thin backrest.

As a second aspect, embodiments of the present invention are directed to a reclining seating unit, comprising: a base configured to rest on an underlying surface; a seat; a backrest that includes a body and a headrest that is positioned above the body; a reclining mechanism that interconnects the base, seat and backrest that controls the movement thereof between an upright position, in which the seat is generally horizontally disposed above the base and the backrest is generally vertically disposed at a first angle to the underlying surface above a rear portion of the backrest, and a fully reclined position, in which the backrest is disposed at a second angle to the underlying surface, the second angle being less than the first angle; and a headrest mechanism that is coupled to the reclining mechanism and attached to the body and headrest. The headrest rests atop the body when the seating unit is in the upright position and separates from the body when the seating unit is in the fully reclined position. The headrest has substantially the same rotative orientation relative to the body whether the seating unit is in the upright or fully reclined position.

As a third aspect, embodiments of the present invention are directed to a headrest mechanism for a reclining seating unit, the seating unit having a base, a seat, a backrest and a reclining mechanism, the seating unit being capable of moving between an upright position, in which the seat is generally horizontally disposed above the base and the backrest is generally vertically disposed at a first angle to the underlying surface above a rear portion of the backrest, and a fully reclined position, in which the backrest is disposed at a second angle to the underlying surface, the second angle being less than the first angle. The headrest mechanism comprises: a headrest drive link adapted to be connected to the reclining seating unit; a conversion link pivotally attached to the headrest drive link and adapted to be attached to a body of the backrest; and a connecting link adapted to be pivotally attached with a headrest of the backrest, wherein the conversion link is coupled with the connecting link.

DETAILED DESCRIPTION OF EMBODIMENTS OF THE INVENTION

Figure 1:
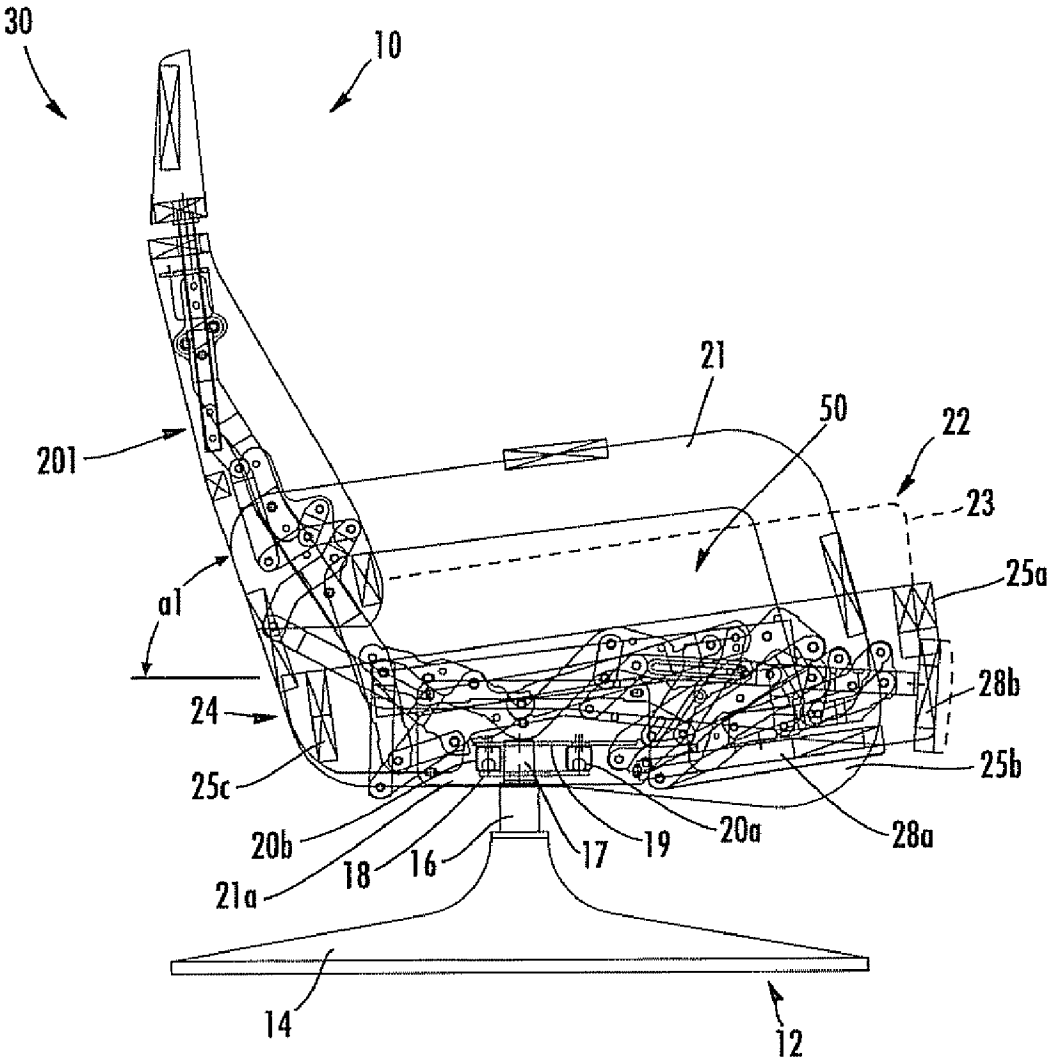
FIG. 1 is a side section view of a reclining chair according to embodiments of the present invention, with the chair in its upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be farther understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Turning now to the figures, a reclining chair, designated broadly at 10, is illustrated in FIGS. 1-5. The chair 10 includes a base unit 12, a seat 22, a backrest 30, two ottomans 28*a*, 28*b*, a pair of mirror image reclining mechanisms 50, and a pair of headrest extension mechanisms 201. These components are described in greater detail below.

Figure 5:
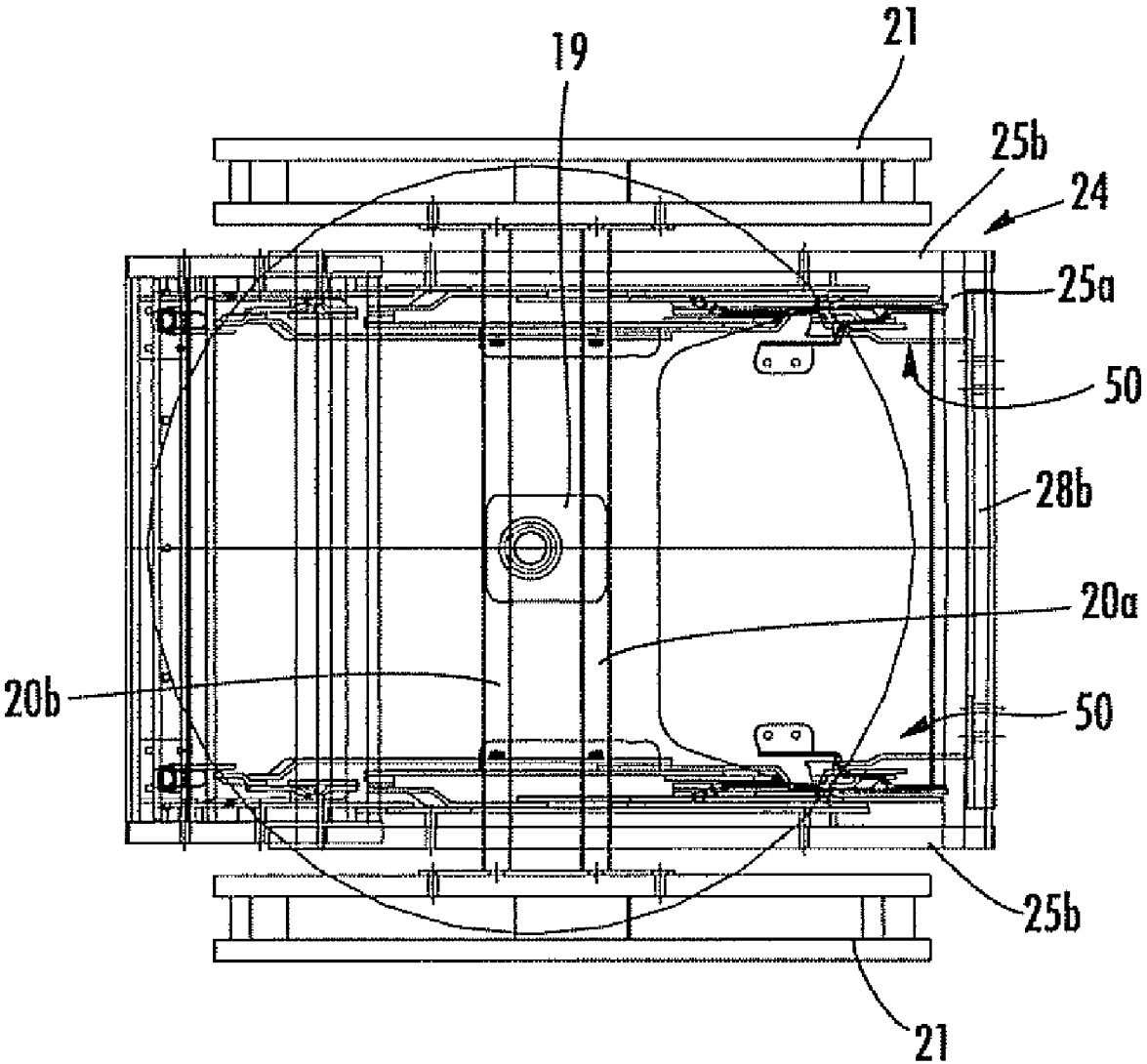
FIG. 5 is a top section view of the chair of FIG. 1, with the chair in its upright position.

Referring now to FIGS. 1 and 5, the base unit 12 includes an inverted funnel-shaped base 14 from which a pedestal 16 extends upwardly. A central spindle 17 is mounted on the pedestal 16. Lower and upper plates 18, 19 are mounted on the spindle 17. Two cross-members 20*a*, 20*b* are mounted between the plates 18, 19 and are fixed at their ends to the arms 21 of the chair 20 via a mounting bracket 21*a*. The reclining mechanisms 50 are then mounted on the upper surfaces of the cross-members 20*a*, 20*b*.

Those skilled in this art will appreciate that the base unit 12 may take any number of different forms. For example, the base 14 may take a different shape and/or form, or may be replaced by a stationary frame or base that supports the cross-members 20*a*, 20*b*. As another example, the cross-members may be omitted, such that the reclining mechanisms 50 are mounted directly to a stationary frame, which would then serve as the base. Other configurations that provide a suitable foundation for the mounting of the remaining components will be recognized by those skilled in this art and need not be described in detail herein.

Referring once again to FIGS. 1 and 5, the seat 22 includes an upper cushion 23 that covers a seat frame 24. In this embodiment, the seat frame 24 is an open rectangular box that has a front cross-member 25*a*, side rails 25*b*, and a rear cross-member 25*c*. The side rails 25*b* have recesses in their lower edges within which the cross-members 20*a*, 20*b* can reside. Those skilled in this art will recognize that the seat 22 and seat frame 24 may take other forms, including those in which the seat frame is not rectangular, that support a seated occupant and provide suitable locations for the mounting of other components, such as the reclining mechanisms 5.

Referring again to FIG. 1, the ottomans 28*a*, 28*b* are upholstered and illustratively include cushions. They are mounted onto links of the reclining mechanisms 50 as described below. Notably, the ottoman 28*a* is longer than the ottoman 28*b*, as the ottoman 28*b* serves as the front panel of the chair 10 in the upright position and, therefore, is limited in length to the height of the seat 22. However, this configuration may be altered in other embodiments.

Referring now to FIGS. 2-5, the chair 10 includes the reclining mechanisms 50 discussed above that enable the chair 10 to move between upright, TV and fully reclined positions (i.e., the reclining mechanisms 50 are three-way reclining mechanisms). The reclining mechanisms 50, only one of which is illustrated herein, are mirror images of one another about a vertical plane that extends longitudinally through the center of the chair 10. As such, only one reclining mechanism 50 will be described herein, with the understanding that those skilled in the art will recognize that this discussion is equally applicable to the reclining mechanism 50 also.

Further, in the interest of clarity, initially the mechanism 50 will be described with respect to FIGS. 1-3, in which the chair 10 is in its upright position; thus, the individual links comprising the mechanism 50 will be described with respect to the orientation shown in FIG. 1. Subsequently the positions and orientations of the individual links will be described with respect to FIGS. 3 and 4, in which the chair 10 is illustrated in its TV and fully reclined positions, respectively.

The reclining mechanism 50 includes linkages that control the movement of the seat frame 24 relative to the base 12, the movement of the ottomans 28*a*, 28*b* relative to the seat frame 24, and the backrest 30 relative to the seat frame 24. The functions of each of the links comprising these linkages will be explained below.

Figure 2:
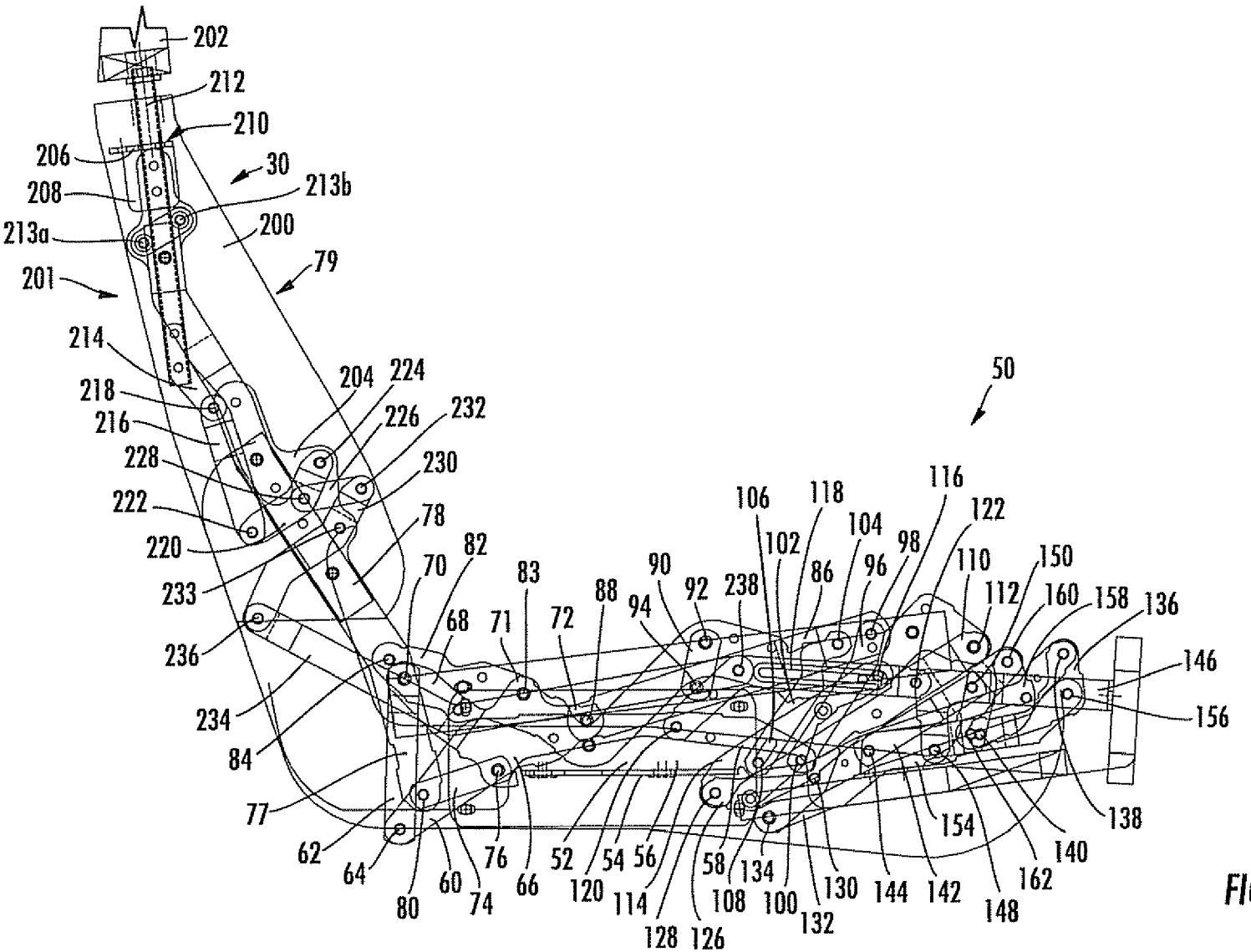
FIG. 2 is an enlarged side section view of the reclining mechanism of the chair of FIG. 1, with the mechanism in the upright position.

Referring now to FIG. 2, the reclining mechanism 50 includes a mounting bracket 52 having a horizontal panel 54 and a vertical panel 56. The horizontal panel 54 includes mounting apertures that are aligned above the cross-members 20*a*, 20*b* of the base 12 and receive fasteners therein. The vertical panel 56 of the mounting bracket 52 is positioned laterally of the horizontal panel 54 and includes a forward portion 58 that extends forwardly of the forwardmost cross-member 20*a* and a rear finger 60 that extends rearwardly and downwardly from the rearwardmost cross-member 20*b*. Thus, the mounting bracket 52 provides a mounting location for the remainder of the reclining mechanism 50.

Still referring to FIG. 2, a straight rear swing link 62 is attached at one end to the rear finger 60 of the mounting bracket 52 at a pivot 64 and extends upwardly and forwardly therefrom. A largely straight front swing link 96 is attached at one end of the forward portion 58 of the mounting bracket 52 at a pivot 100 and extends upwardly and forwardly therefrom. The upper ends of the rear swing link 62 and the front swing link 96 are interconnected via a straight transition link 86, which is attached at its forward end to the upper end of the front swing link 96 at a pivot 98, and a full recline swing link 66, which includes a rear projection 68 and tabs 71, 72. The rear projection 68 is attached to the end of the rear swing link 62 opposite the pivot 64 at a pivot 70. The tab 71 of the full recline swing link 66 is attached to the rear end of the transition link 86 at a pivot 88. The tab 72 is attached to a seat mounting bracket 82 at a pivot 83. The seat frame 24 is fixed to and above the seat mounting bracket 82. A short control link 90 extends downwardly and slightly rearwardly from a pivot 92 with a seat mounting bracket 82 to a pivot 94 with the intermediate portion of the transition link 86. These links largely control the movement of the seat frame 24 relative to the base 12.

Referring again to FIG. 2, a straight recline actuating link 74 is attached to the full recline swing link 66 at a pivot 76 and extends rearwardly therefrom. A backpost 77 is pivotally attached at its lower end to the rearward end of the recline actuating link 74 at a pivot 80. The seat mounting bracket 82, which extends longitudinally much of the length of the seat 22, is pivotally attached at its rear portion to an intermediate portion of the backpost 77 via a pivot 84. These links are largely responsible for controlling the pivoting of the backrest 30 relative to the seat 22.

Referring yet again to FIG. 2, links that are largely responsible for the extension of the ottomans 28*a*, 28*b* are described below. A sequencer link 102 extends generally parallel with the front swing link 96 and is connected with the transition link 86 at a pivot 104 located just rearwardly from the pivot 98. At its opposite end, the sequencer link 102 has a slot 106 that interacts with a pin 108 located at the forward end of the mounting bracket 52; in the upright position, the pin 108 is seated in the lower end of the slot 106. A front ottoman swing link 110 is attached to the forwardmost end of the seat mounting bracket 82 at a pivot 112 and extends rearwardly and downwardly therefrom. A substantially parallel rear ottoman swing link 114 is attached to the seat mounting bracket 82 at a pivot 116 positioned rearward and downward of the pivot 112. An angled ottoman actuator link 118 is attached to the front ottoman swing link 110 at a pivot 122 and extends rearwardly and slightly downwardly to a pivot 120 on the mounting bracket 52. A long tipper ottoman extension link 126 is attached to the rear end of the rear ottoman swing link 114 at a pivot 128 and to an intermediate portion of the front ottoman swing link 110 at a pivot 130. The upper ottoman extension link 126 extends forwardly and slightly upwardly from the pivot 130 to terminate near the front end of the seat 22. A tripartite lower ottoman extension link 132 is generally parallel to the upper ottoman extension link 126 and is attached at one end to the end of the front ottoman swing link 110 at a pivot 134. An L-shaped front ottoman carrier link 136 is attached at one end to the end of the upper ottoman extension link 126 at a pivot 138, and at its other end to an intermediate portion of the lower ottoman extension link 132 at a pivot 162. The front ottoman swing link 110, rear ottoman swing link 114, upper ottoman extension link 126, lower ottoman extension link 132 and front ottoman carrier link 136 form a pantographic linkage that extends the ottomans 28*a*, 28*b* in a "scissors" fashion to a position forward of the seat frame 24. This movement is driven by the ottoman actuator link 118.

Referring further to FIG. 2, a straight intermediate ottoman drive link 142 is attached at one end to an intermediate portion of the upper ottoman extension link 126 at a pivot 144 and extends upwardly and forwardly therefrom. An L-shaped intermediate ottoman bracket 146 is attached at one end to an intermediate portion of the lower ottoman extension link 132 and extends upwardly, then forwardly to terminate at the ottoman 28*b* located just forwardly of the seat frame 24. The intermediate ottoman drive link 142 is attached at its forward end to an intermediate portion of the intermediate ottoman bracket 146 at a pivot 150. The intermediate ottoman drive link 142 and intermediate ottoman bracket 146 are driven by the upper ottoman extension link 126 and lower ottoman extension link 132 to control the movement of the ottoman 28*b*.

A front ottoman bracket 154 is attached at a pivot 156 to the front ottoman carrier link 136. At its opposite end, the front ottoman bracket 154 is attached to the ottoman 28*a*. An L-shaped front ottoman drive link 158 is attached at one end to the end of the lower ottoman extension link 132 at a pivot 160 and at its opposite end to an intermediate portion of the front ottoman bracket 154 at a pivot 162. The front ottoman carrier link 136, front ottoman drive link 158, and front ottoman bracket 154 control the movement of the front ottoman 28*a*.

Referring still to FIG. 2, the backrest 30 includes a body 200 and an extendable headrest 202. The headrest 202 can be extended from the body 200 by the headrest mechanism 201. These components are described below.

The body 200 includes the backrest frame 79, to which is fixed a backpost extension 204 via a shim 78, that is also fixed to the upper end of the backpost 77. A bracket 206 is fixed to the upper ends of the backpost extension 204 via flanges 208. Holes 210 are present in the cross-member 206.

The headrest mechanism 201 includes a pair of posts 212 (only one of which is shown in FIG. 2), which are fixed to the underside of the headrest 202. The posts 212 are inserted into the holes 210 in the cross-member 206 of the body 200. Each post 212 is fixed at its lower end to a post extension 214, which extends downwardly and slightly forwardly. In addition, each post 212 extends between a pair of rollers 213*a*, 213*b* that are mounted on the backpost extension 204. A straight connecting link 216 is pivotally attached to the lower end of the post extension 214 at a pivot 218 and extends downwardly and slightly forwardly therefrom. A slightly bent extension link 220 is pivotally attached to the lower end of the connecting link 216 at a pivot 222 and extends upwardly and forwardly to a pivot 224 with the backpost extension 204. A control link 226 is attached to the vertex of the extension link 220 at a pivot 228 and extends forwardly therefrom. A conversion link 230 extends downwardly and rearwardly from a pivot 232 with the control link 226. The conversion link 230 is also attached to the backpost extension 204 at a pivot 233. An angled headrest drive link 234 is attached at one end to the vertex of the ottoman actuator link 118 at a pivot 238 and at its opposite end to the lower end of the transition link 230 at a pivot 236; the headrest drive link 234 couples the headrest mechanism 201 with the reclining mechanism 50.

Figure 3:
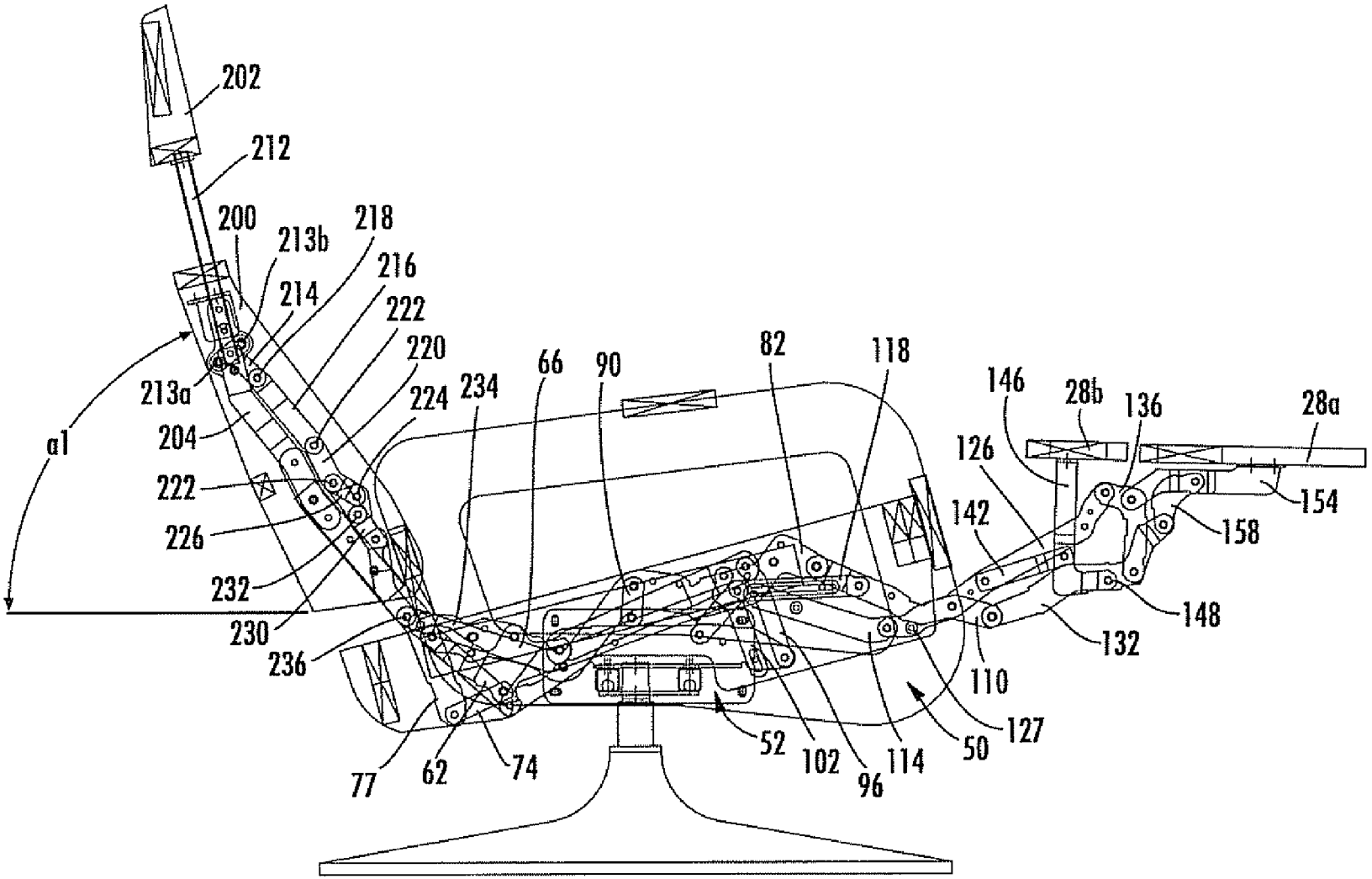
FIG. 3 is a side section view of the chair of FIG. 1, with the chair in its TV position and the headrest extended.
Figure 4:
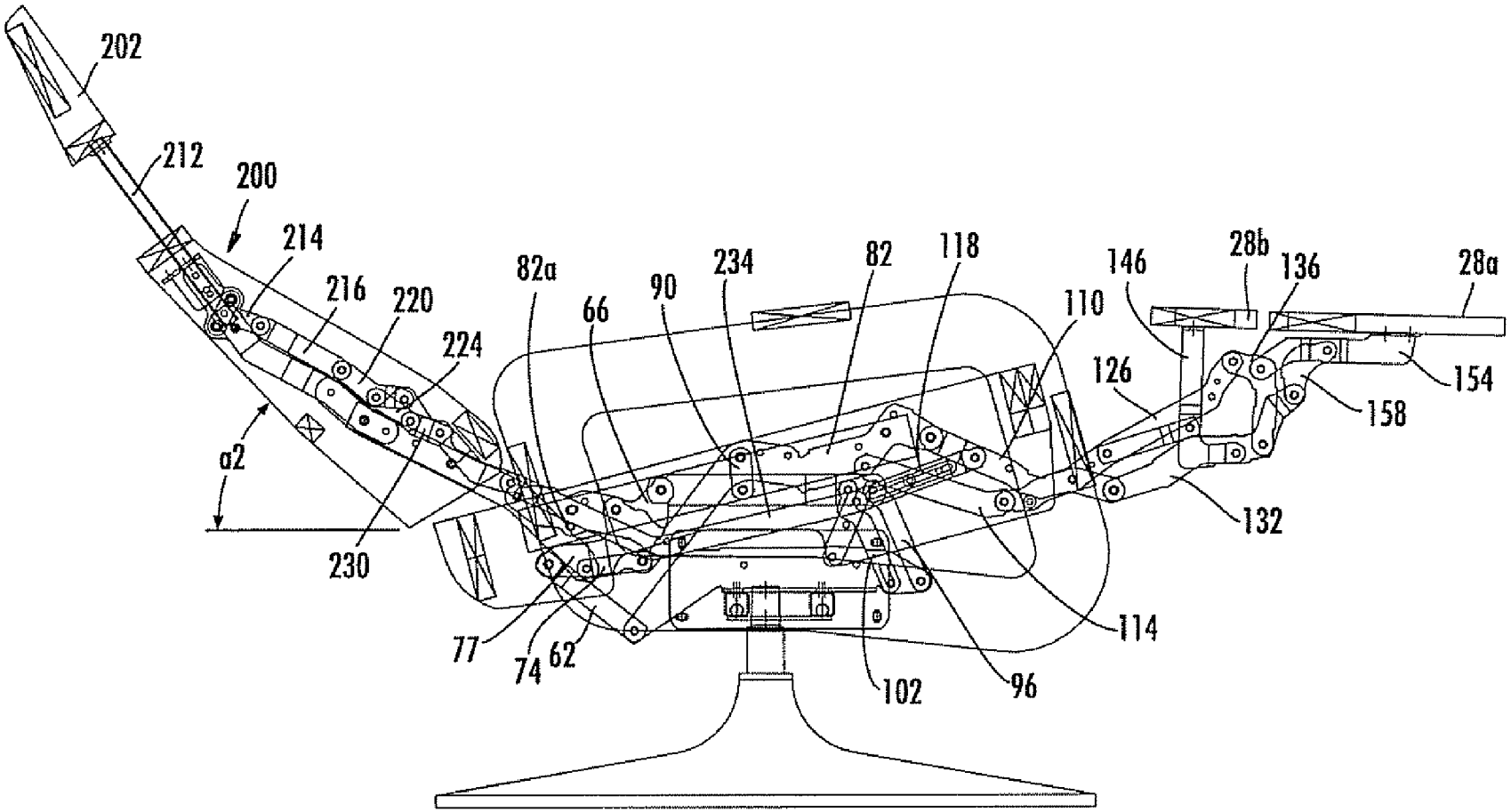
FIG. 4 is a side section view of the chair of FIG. 1, with the chair in its fully reclined position and the headrest extended.

To move the chair 10 from the upright position of FIGS. 1, 2 and 5 to the TV position of FIG. 3, the occupant of the chair 10 pushes on the arms 21 while pressing back with his back on the backrest 30. This rearwardly-directed force causes the backrest 30 and, in turn, the backpost 77 to draw the top end of the rear swing link 62 and the seat mounting bracket 82 rearwardly. After the top end of the rear swing link 62 travels rearwardly of the pivot 64, the mechanisms 50 release to the TV position, in which the seat 22 moves rearwardly relative to the base 12. The rearward movement of the rear swing link 62 draws the full recline swing link 66 and, in turn, the transition link 86 rearwardly without rotation; similarly, the control link 90 and the recline actuating link 74 are drawn rearwardly, but do not rotate relative to the backrest support link 77 and base 12.

The rearward movement of the transition link 86 draws the top ends of the front swing link 96 and the sequencer link 102 rearwardly. Also, the rearward movement of the seat mounting bracket 82 causes the footrest actuator link 118 to drive the lower end of front ottoman swing link 110 forward. This action causes the lower end of the upper ottoman extension link 126 to extend, thereby drawing the lower end of the rear ottoman swing link 114 forward. Extension of the upper ottoman extension link 126 also causes the front ottoman carrier link 136 to rotate (counterclockwise as shown in FIGS. 2 and 3), which in turn draws the lower end of the lower ottoman extension link 132 forward. The movement of the upper and lower ottoman extension links 126, 132 ceases when the front ottoman swing link 110 contacts a pin 127 located on the upper ottoman extension link 126.

As the upper and lower ottoman extension links 126, 132 extend forwardly, the intermediate ottoman drive link 142 and the intermediate ottoman bracket 146 are carried forward also. The intermediate drive link 142 substantially maintains its orientation, but the movement of the lower ottoman extension link 132 causes the intermediate ottoman bracket 146 to rotate about the pivot 148 such that the ottoman 28*b* rises and rotates to a generally horizontal disposition (the rotation is counterclockwise from the vantage point of FIG. 4).

Also, the extension of the upper and lower ottoman extension links 126, 132 carries the front ottoman drive link 158 and the front ottoman bracket 154 forward. As the front ottoman carrier link 136 rotates, it causes the front ottoman bracket 154 to rotate around pivot 156 (the rotation is counterclockwise from the vantage point of FIG. 3). This rotation is controlled by the front ottoman drive link 158, which also rotates counterclockwise. The rotation of the front ottoman bracket is sufficient to invert the ottoman 28*a* from a horizontal disposition in which the ottoman 28*a* faces downwardly to a horizontal disposition in which the ottoman 28*a* faces upwardly.

In addition, the forward movement of the ottoman actuator link 118 draws the headrest drive link 234 forward relative to the seat 22. As a result, the conversion link 230 rotates counterclockwise about the pivot 233. This action drives the control link 226 rearwardly. The control link 226 also rotates clockwise about the pivot 232, which rotation forces the extension link 220 to rotate clockwise relative to the backpost 77 about the pivot 224. This movement drives the connecting link 216 upwardly, which in turn drives the post extension 214 and posts 212 upwardly through the holes 210 in the cross-member 206. Movement of the lower ends of the posts 212 is also controlled by the presence of the rollers 213*a*, 213*b*.

The ascension of the posts 212 separates the lower edge of the headrest 202 from the upper edge of the body 200 in a direction generally parallel to the backrest 30. The gap between the lower edge of the headrest 202 and the upper edge of the body 200 is between about 2 and 8 inches. In this extended position, the headrest 202 substantially maintains the same rotative orientation as in the retracted position.

The chair 10 can be moved to the fully reclined position (shown in FIG. 4) by the occupant again pushing forward on the arms 19 and rearward on the backrest 30 when the chair 10 is in the TV position. The rearward force on the backrest 30 causes the backpost 77 to rotate about the pivot 84 such that the upper end of the backrest support link 77 moves rearwardly and downwardly (this rotation is clockwise from the vantage point of FIGS. 3 and 4). The pivoting of the backrest support link 77 drives the recline actuating link 74 forward, which in turn causes the full recline swing link 66 to rotate counterclockwise. As the front portion of the full recline swing link 66 rises, it draws the rear end of the transition link 86 upwardly. This action raises the control link 90, and consequently the seat mounting bracket 82 and the seat 22, upwardly and slightly rearwardly. The movement to the fully reclined position ceases when the backpost 77 strikes a pin 82*a* that is attached to the seat mounting bracket 82, at which point the seat 22 has risen about 2 inches and moved about 1 inch rearwardly. The backrest 30 has an angle a2 with the underlying surface (FIG. 4) that is less that an angle a1 that the backrest 30 forms with the underlying surface in the upright and TV positions (FIGS. 1 and 3).

During the movement of the chair 10 to the fully reclined position, the relationship between the front and rear ottoman swing links 110, 114 remains essentially unchanged. As a result, the ottomans 28*a*, 28*b* rise and move slightly rearwardly in synchronous motion with the seat 22 but otherwise remain extended as in the TV position of FIG. 4.

In addition, the relationship between the backpost 77 and the transition link 230 is largely undisturbed, with the transition link 230 pivoting only slightly about the pivot 233 in response to the movement of the headrest drive link 234. Consequently, when the chair 10 moves to the fully reclined position, the headrest 202 remains in an extended position separated from the body 200 of the backrest 30.

The chair 10 can be returned from the fully extended position to the TV position by the occupant pulling forwardly on the arms 14, which reverses the motion of the aforementioned links and enables the chair 10 to take the TV position. The chair can be returned to the upright position from the TV position by the occupant pushing downwardly on the ottoman 28*a*, at which time the links described above as driving the chair to the TV position reverse their motion until the chair has returned to the upright position. When the chair 10 returns to the upright position, the headrest 202 returns to its position adjacent the upper edge of the body 200.

Figure 6:
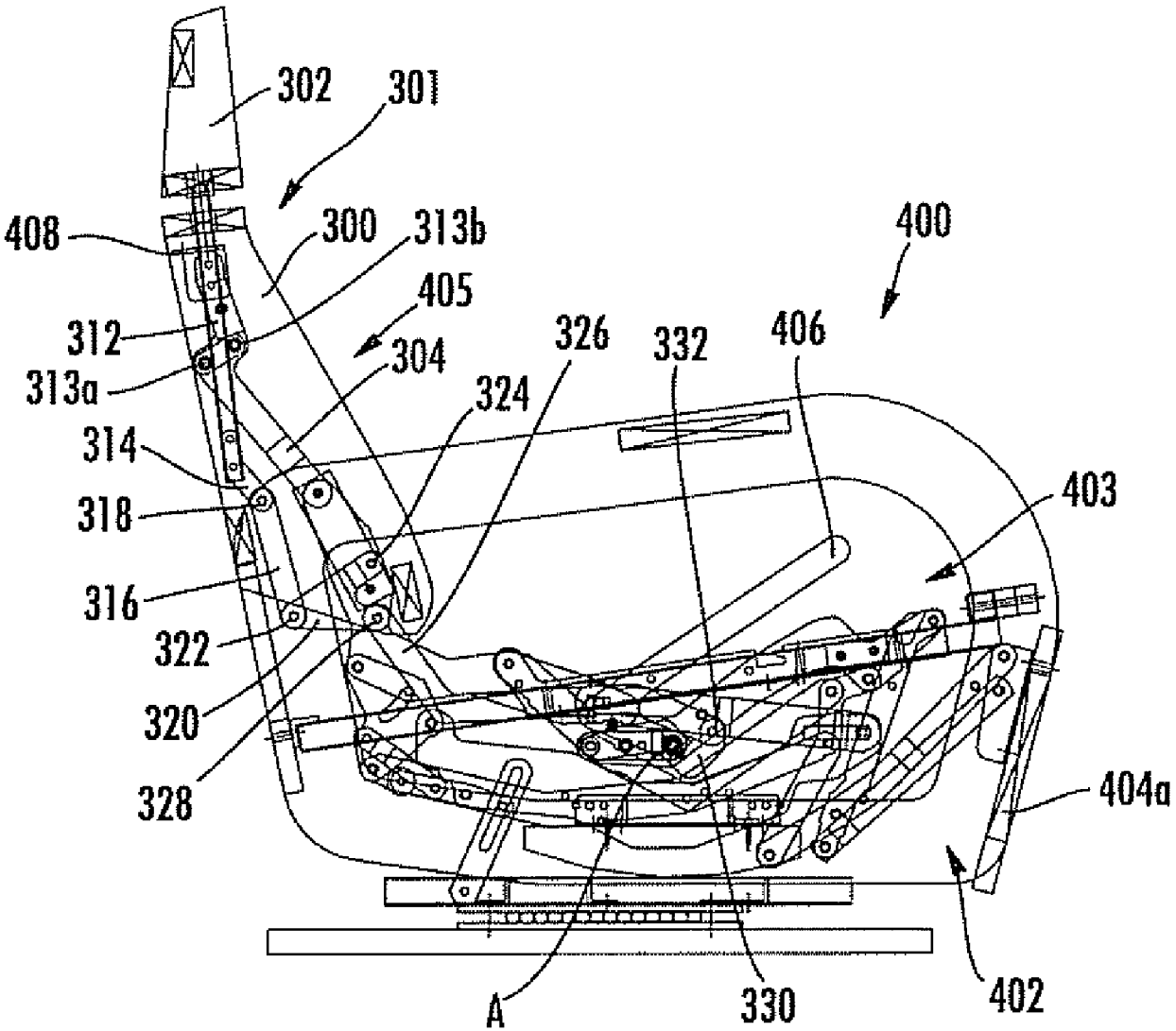
FIG. 6 is a side section view of a reclining chair according to alternative embodiments of the present invention.
Figure 7:
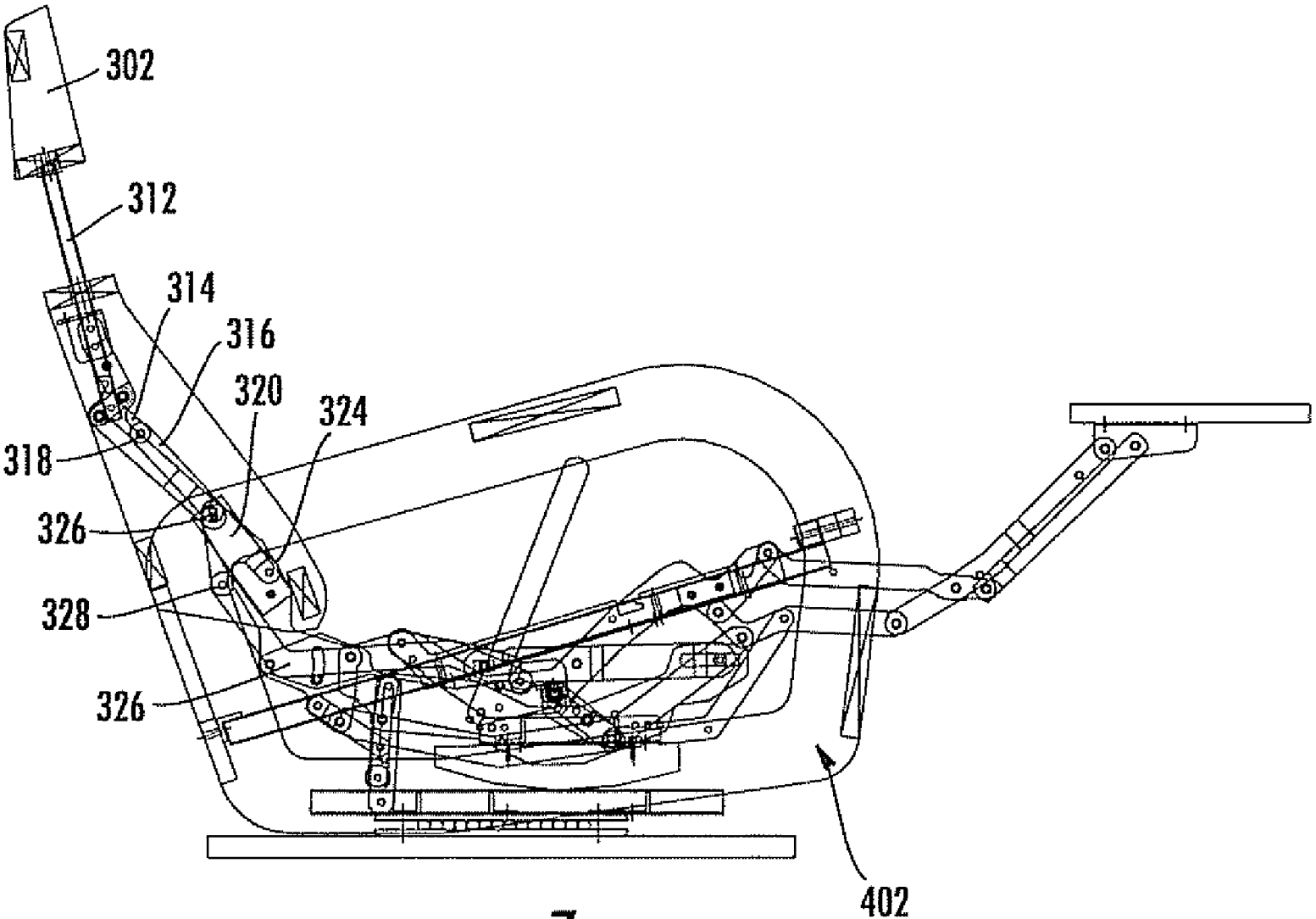
FIG. 7 is a side section view of the chair of FIG. 6, with the chair in its TV position and the headrest extended.
Figure 8:
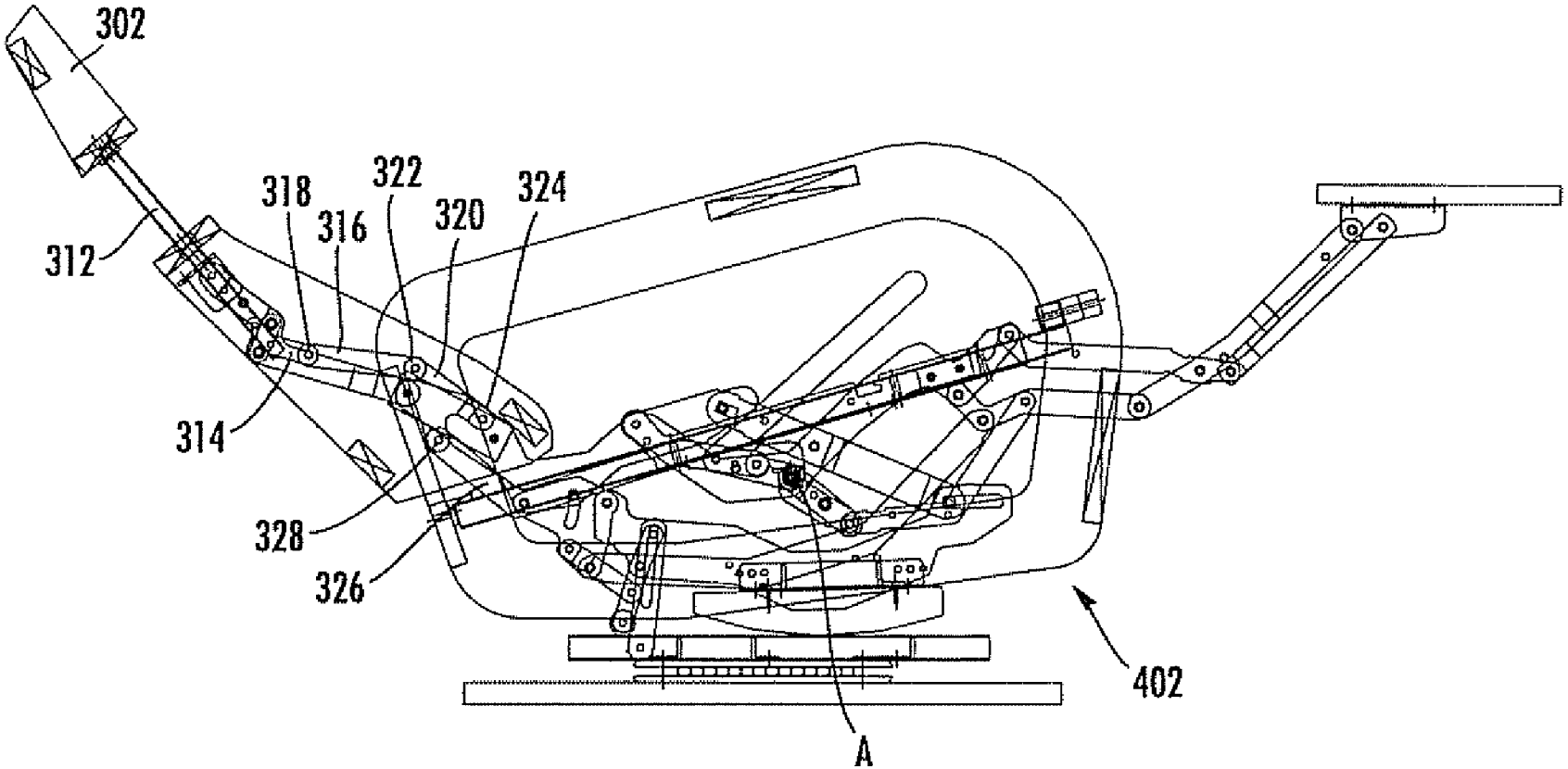
FIG. 8 is a side section view of the chair of FIG. 6, with the chair in its fully reclined position.

Referring now to FIGS. 6-8, an additional embodiment of a rocker-recliner chair, designated generally at 400, is shown therein. The chair 400 includes a reclining mechanism 402 that moves a seat 403, on ottoman 404*a* and a backrest 405 between upright, TV and fully reclined positions (FIGS. 6, 7 and 8 respectively). The chair 400 is moved between the upright and TV positions with the aid of a handle 406.

The backrest 405 includes a body 300 and a headrest 302 with posts 312 and post extensions 314, similar to those of the backrest 30 shown above. The post extension 314 is pivotally connected at a pivot 318 to a connecting link 316 of a backrest mechanism 301 (also similar to the backrest 30). However, in this embodiment the connecting link 316 is connected to a V-shaped conversion link 320 at a pivot 322 located near the vertex of the conversion link 320. One leg of the conversion link 320 is connected to the backpost extension 304 at a pivot 324; the other leg of the conversion link 320 is connected at a pivot 328 to the rear end of a headrest drive link 326. The headrest drive link 326 is then connected at a pivot 332 to a crank 330 that is fixed to the handle 406.

When the handle 406 rotates about an axis A, the reclining mechanism 402 causes the ottomans 404*a*, 404*b* to extend in front of the seat 403. At the same time, rotation of the handle 406 (counterclockwise in FIGS. 6-8) forces the headrest drive link 326 rearwardly. This action rotates the conversion link 320 clockwise about the pivot 324. Rotation of the conversion link 320 drives the connecting link 316, and in turn the post extension 314, the posts 312, and the headrest 302, upwardly. Front-to-back movement of the headrest 302 is controlled by a bracket 408 through which the posts 312 extend and by the presence of rollers 313*a*, 313*b*.

Those skilled in this art will recognize that the backrest mechanisms 201, 301 may also take other configurations. For example, either of the embodiments illustrated above may replace the rollers that help to guide the lower ends of the headrest posts with flanges or other bearing surfaces, or may include one or more links (e.g. a link pivoted to the backrest that forms a parallelogram in conjunction with the conversion link 320 and the connecting link 316) to guide the lower ends of the posts. Alternatively, the post and post extension may be formed of a single member, and/or the backpost extension may be formed in conjunction with the backpost, may be divided into multiple components, or may be omitted altogether such that the other links of the headrest mechanism are mounted directly to the backrest. Other alternatives will be recognized by those skilled in this art.

Those skilled in this art will recognize that other reclining mechanism configurations and portions thereof may be employed with the present invention. For example, portions of a three-way mechanism illustrated in U.S. Pat. No. 4,418,957 to Rogers that move the backrest and seat relative to the base may be employed. Similarly, portions of the pressback mechanisms illustrated in U.S. Pat. No. 5,775,775 to Hoffman that extend the ottoman may be employed. Other mechanisms may also be suitable for use with the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A reclining seating unit, comprising:

a base configured to rest on an underlying surface;

a seat;

a backrest that includes a body and a headrest that is positioned above the body, the headrest having front and rear surfaces;

an ottoman;

a reclining mechanism that interconnects the base, seat, ottoman and backrest that controls the movement thereof between an upright position, in which the seat is generally horizontally disposed above the base and the backrest is generally vertically disposed at a first angle to the underlying surface above a rear portion of the seat, a TV position, in which the ottoman is generally horizontally disposed and extended in front of the seat and the backrest remains substantially at the first angle relative to the underlying surface, and a fully reclined position, in which the backrest is disposed at a second angle to the underlying surface, the second angle being less than the first angle; and a headrest mechanism coupled to the reclining mechanism and attached to the body and headrest, wherein in the upright position, a lower edge of the headrest is positioned at a first distance from an upper edge of the body, and wherein in the TV position and the fully reclined position, the lower edge of the headrest is positioned a second distance from the upper edge of the body, the second distance being greater than the first distance;

wherein the headrest moves generally parallel to the backrest as the chair moves from the upright to the TV position and the fully reclined position and has substantially the same rotative orientation relative to the body whether the seating unit is in the upright, TV or fully reclined position; and wherein in the upright position, the front and rear surfaces of the headrest are fully visible.

2. The seating unit defined in claim 1, wherein the second distance is between about 2 and 8 inches in the reclined position.

3. The seating unit defined in claim 1, wherein the headrest mechanism includes a headrest drive link, a conversion link pivotally attached to the headrest drive link and to the backrest body, and a connecting link pivotally attached with the headrest, wherein the conversion link is pivotally coupled with the connecting link.

4. The seating unit defined in claim 3, wherein the conversion link is directly pivotally coupled to the connecting link.

5. The seating unit defined in claim 3, wherein the conversion link is coupled to the connecting link via a control link connected to the conversion link and an extension link pivotally connected to the control link, the connecting link and the backrest body.

6. A reclining seating unit, comprising:

a base configured to rest on an underlying surface;

a seat;

a backrest that includes a body and a headrest that is positioned above the body;

an ottoman;

a reclining mechanism that interconnects the base, seat, ottoman and backrest that controls the movement thereof between an upright position, in which the seat is generally horizontally disposed above the base and the backrest is generally vertically disposed at a first angle to the underlying surface above a rear portion of the seat, a TV position, in which the ottoman is generally horizontally disposed and extended in front of the seat and the backrest remains substantially at the first angle relative to the underlying surface, and a fully reclined position, in which the backrest is disposed at a second angle to the underlying surface, the second angle being less than the first angle; and a headrest mechanism coupled to the reclining mechanism and attached to the body and headrest, wherein in the upright position, a lower edge of the headrest is positioned above and at a first distance from an uppermost edge of the body, and wherein in the TV position and the fully reclined position, the lower edge of the headrest is positioned a second distance from the uppermost edge of the body, the second distance being greater than the first distance; and wherein the headrest moves generally parallel to the backrest as the chair moves from the upright to the reclined position and has substantially the same rotative orientation relative to the body whether the seating unit is in the upright, TV or fully reclined position.

7. The seating unit defined in claim 6, wherein the difference between the first and second distances is between about 2 and 8 inches in the reclined position.

8. The seating unit defined in claim 6, wherein the headrest mechanism includes a headrest drive link, a conversion link pivotally attached to the headrest drive link and to the backrest body, and a connecting link pivotally attached with the headrest, wherein the conversion link is coupled with the connecting link.

9. The seating unit defined in claim 8, wherein the conversion link is directly pivotally coupled to the connecting link.

10. The seating unit defined in claim 8, wherein the conversion link is coupled to the connecting link via a control link connected to the conversion link and an extension link pivotally connected to the control link, the connecting link and the backrest body.

11. A reclining seating unit, comprising:

a base configured to rest on an underlying surface;

a seat;

a backrest that includes a body and a headrest that is positioned above the body, the headrest having front and rear surfaces;

an ottoman;

a reclining mechanism that interconnects the base, seat, ottoman and backrest that controls the movement thereof between an upright position, in which the seat is generally horizontally disposed above the base and the backrest is generally vertically disposed at a first angle to the underlying surface above a rear portion of the seat, a TV position, in which the ottoman is generally horizontally disposed and extended in front of the seat and the backrest remains substantially at the first angle relative to the underlying surface, and a fully reclined position, in which the backrest is disposed at a second angle to the underlying surface, the second angle being less than the first angle; and a headrest mechanism coupled to the reclining mechanism and attached to the body and headrest, wherein in the upright position, a lower edge of the headrest is positioned at a first distance from an upper edge of the body, and wherein in the TV position and the fully reclined position, the lower edge of the headrest is positioned a second distance from the upper edge of the body, the second distance being greater than the first distance;

wherein the headrest moves generally parallel to the backrest as the chair moves from the upright to the TV position and the fully reclined position and has substantially the same rotative orientation relative to the body whether the seating unit is in the upright, TV or fully reclined position; and wherein in the upright position, the front and rear surfaces of the headrest are fully visible; and wherein the headrest mechanism includes a headrest drive link, a conversion link pivotally attached to the headrest drive link and to the backrest body, and a connecting link pivotally attached with the headrest, wherein the conversion link is coupled with the connecting link.

12. The seating unit defined in claim 11, wherein the conversion link is directly pivotally coupled to the connecting link.

13. The seating unit defined in claim 11, wherein the conversion link is coupled to the connecting link via a control link connected to the conversion link and an extension link pivotally connected to the control link, the connecting link and the backrest body.

14. The seating unit defined in claim 11, wherein the second distance is between about 2 and 8 inches in the reclined position.

* * * * *